US005924459A

United States Patent [19]

Evans

[11] Patent Number: 5,924,459

[45] Date of Patent: Jul. 20, 1999

[54] AIR JET MACHINE AND DIAGONAL Z LOOP FABRIC PATTERN FOR THREE-DIMENSIONAL FABRIC

[76] Inventor: Rowland G. Evans, 1320 Independence Ave. SE., Washington, D.C. 20003

[21] Appl. No.: 08/867,066

[22] Filed: Jun. 2, 1997

[51] Int. Cl.[6] ..... D03D 13/00; D03D 25/00; D03D 41/00

[52] U.S. Cl. ..... 139/11; 139/DIG. 1

[58] Field of Search ..... 139/11, DIG. 1

[56] References Cited

U.S. PATENT DOCUMENTS

| | | | |
|---|---|---|---|
| 3,834,424 | 9/1974 | Fukuta et al. | 139/11 |
| 4,614,212 | 9/1986 | Olenwine | 139/79 |
| 5,085,252 | 2/1992 | Mohamed et al. | 139/11 |
| 5,137,058 | 8/1992 | Anahara | 139/DIG. 1 |
| 5,449,025 | 9/1995 | Weinberg | 139/DIG. 1 |

*Primary Examiner*—Andy Falik

[57] ABSTRACT

A machine that uses modified air jet technology for weft insertion, knitting needles for Z yarn insertion and "closers" to close the warp sheds before beating to produce three-dimensional fabric in flat, wide panels at high speed. The fabric is characterized by a pattern consisting of the conventional multiple rows of X, Y and Z yarns orthogonal at 90° to each other but which has each Z yarn loop diagonally over a warp and a weft yarn alternately at +45° and −45° at both the top and bottom edges of the fabric. The diagonal loops permit the fabric to be made with either an equal number of rows of warp and weft yarns, or one more than or one less row of warp than weft yarns, and also have its right and left edges bound by Z yarns.

2 Claims, 2 Drawing Sheets

AIR JET MACHINE AND DIAGONAL Z LOOP FABRIC PATTERN FOR THREE-DIMENSIONAL FABRIC

BACKGROUND OF THE INVENTION

1. Field of Invention

This invention pertains to weaving three-dimensional fabric and to a new pattern of three-dimensional fabric.

2. Description of the Prior Art

Three-dimensional fabric structures are primarily useful as the reinforcing material for a range of composite materials in which plastic resins or ceramics are used to impregnate a tailored fabric material which is then molded and cured into composite products having commercially useful physical properties tailored to acheive a desired composite application in a cost effective process.

The three basic different fabric manufacturing techniques, e.g. weaving, braiding and knitting, have all been previously used to produce three-dimensional fabric. This invention dose not pertain to braiding and knitting.

In the field of weaving, Fukuta, U.S. Pat. No. 3,834,424, disclosed the basic patent for weaving three-dimensional orthogonal fabric. The rows of yarns in the fabric produced are orthogonal at 90° to each other in each of the X (warp), Y(weft), and (thickness) planes. Krauland, U.S. Pat. No. 4,526,026, and Mohamed et at, U.S. Pat. No. 5,085,252, disclose enhancements to Fukuta's method and fabric. All these machines use rapiers for weft insertion which causes them to have slow weaving speed. Further, the weaving speed is proportionally reduced as fabric width is increased. Also, practical fabric width is limited with these machines.

However, it is noted that the pattern of the fabric in these inventions appears superficially similar to this invention fabric pattern but on close examination contains several fundamental differences.

In all these machines, the fabric produced has the Z (thickness) yarns loop in the longitudinal direction (X, warp axis) over the top most Y (weft) yarn at the top. In their fabric, the Z yarns loop in the longitudinal direction (X axis) over the top most Y yarn at the top edge or under the bottom most Y yarn at the bottom edge of the fabric. Thus, the top and bottom yarns must be Y yarns and therefore there must be one more row of Y yarns than X yarns. In this invention fabric, the Z yarns loop diagonally over both an X and Y yarn at the top edge and under both an X and Y yarn at the bottom edge of the fabric at alternating angles of +45° and −45° to the longitudinal direction. Thus, the top most and bottom most rows of yarn may be either and X or a Y row and may be different at top from bottom. This provides the flexibility to make the number of rows of X (warp) yarns to be equal to, one more than, or one less than the number of rows of Y (weft) yarns.

In addition, the method of binding the right and left edges is different. In prior inventions, the side edges are either bound by Y yarns looped horizontally in the X direction around Z yarns or bound by independent loop stitches through the thickness of the fabric at its edges. In this invention fabric, the Z yarns bind the right most and the left most X yarns to the fabric with the +45° and −45° Z yarn loops at the top and bottom edges of the fabric. In addition to the above inventions in the field of weaving, Anahara et al., U.S. Pat. No. 5,137,058; Farely, U.S. Pat. No. 5,224,519 and Mohamed et al., U.S. Pat. No. 5,465,760 disclose different methods of inserting paired rows or sheets of bias yarns in the longitudinal plane between the respective rows or sheets of longitudinal yarns of a conventional woven X, Y, Z three-dimensional fabric. In all of these, the rows of Z thickness yarns loop over Y (weft) yarns the same as previously discussed for other three-dimensional fabric weaving looms. These machines also use rapiers for weft insertion and this, together with their bias yarn insertion, results in slow weaving speeds. The speeds are proportionally reduced as fabric width is increased and they are limited in the practical width of fabric they can produce.

Also in the field of weaving, Weinberg, U.S. Pat. No. 5,449,025 discloses a method of weaving X, Y, Z three-dimensional fabric utilizing a novel means for opening sheds in the Y plane for insertion of Y (weft) yarns and also in the Z plane for insertion of Z (thickness) yarns. However, this shed opening device limits the width of fabric that can be produced. Specifically, fabric widths exceeding a half meter rapidly become impractical with such a shed opening device. In addition, in the fabric produced, the Z yarns loop over the top most or bottom most Y yarns; therefore, the number of Y yarns must always be one more than the number of X yarns. Further, in the fabric produced, the method of binding the right and left side edges is to loop Y yarns over Z yarns.

Further, in the field of weaving, U.S. Pat. Nos. 4,031,922; 4,046,173; 4,066,104; 4,140,156 and 4,438,173 disclose several different methods of triaxial weaving. Triaxial woven fabric is not a true three-dimensional fabric because it is a single layer fabric, not a multilayer fabric. The fabric produced also has the major limitation that the yarns are heavily crimped and are not orthogonal to each other. This invention does not pertain to traxial weaving.

Also in the field of weaving, U.S. Pat. Nos. 3,904,464; 3,993,817; 4,001,478; and 4,080,915 discloses methods for weaving hollow cylindrical fabric structures. These machines are not capable of producing flat panels of fabric. This invention does not pertain to cylinderical weaving.

BRIEF SUMMARY OF THE INVENTION

In summary, this invention machine combines knitting and weaving techniques with modified air jet technology to produce flat panels of three-dimensional fabric in wide widths at very high speed. This invention machine can also produce wider widths of three-dimensional fabric. In addition, this invention machine can produce three-dimensional fabric in which the numbers of rows of X and Y yarns are more flexibly tailored to end use composite applications. It consists of the following major components which perform the described functions. First X yarn guides hold the rows of longitudinal X (warp) yarns far enough apart for weft insertion. Next, a modified commercially available air jet system is used to simultaneously insert a row of Y (weft) yarns in the transverse direction through the open sheds between the rows of X yarns. Then a shed closer device closes the sheds, i.e. brings the X and Y yarns together to the approximate thickness of the finished fabric and also reopens the sheds when the beat is complete. A row of multiple knitting needles mounted in a needle bar is used to insert a row of Z yarns in the vertical plane and to form the diagonal loops of the Z yarns under the warp and weft yarns at the bottom edge of the fabric. A Z yarn guide positions the Z feed yarns in exact position for the needles to catch a new yarn on each stroke and to form diagonal loops of Z yarns at the top edge of the fabric. A beat reed is used to beat the rows of Y yarns into the fell of the fabric, i.e. compact the Y yarns into the completed fabric.

In summary, the invention fabric pattern which is woven by the inventive machine consists of multiple rows of longitudinal X (warp) yarns, multiple rows of Y (weft) yarns and multiple rows of Z yarns which are held straight in orthogonal planes 90° to each other and which has the Z yarns loop diagonally over/under both an X and a Y yarn alternately at +45° or +45° at the top/bottom edges of the fabric. This fabric also has the right and left edges bound by Z yarns. The number of rows of X yarns may be equal to, one more or one less than the number of rows of Y yarns.

The ability to vary the number of rows of X and Y yarns facilitates tailoring the physical properties of the fabric to the desired composite application Specifically, the end use composite application may require equal strength in the X and Y directions facilitated by the number of rows of X yarns equal to the number of Y yarns. This is frequently the case in structural panel applications such as walls, partitions, floors, boat hulls, and other panels. Similarly, panel applications requiring greater strength in the X or in the Y direction are facilitated by more X or more Y rows of yarn. This invention fabric has more flexibility to provide tailored composite properties at lower cost.

BRIEF DESCRIPTION OF SEVERAL VIEWS OF THE DRAWINGS

FIG. 3 shows the pattern of this invention fabric in two additional variations.

DETAILED DESCRIPTION OF THE INVENTION

The inventive three-dimensional fabric pattern with diagonal Z yarn loops produced by this machine shall now be described in detail.

It should be understood that the terms "up, down, right, left, top, bottom" and so on, shall be used only for the sake of clarity and that this invention apparatus may operate in various other orientations.

It should be understood that X, Y and Z refer to the X, Y, Z axes in a conventional orthogonal cartesian coordinate system in which the X axis is oriented in the longitudinal output or warp direction, the Y axis is oriented in the transverse or weft direction and the Z axis is oriented in the vertical upward or thickness direction. The X plane contains the X and Y axes, the Y plane contains the Y and Z axes and the Z plane contains the Z and X axes. This notation system is used for the sake of clarity and other notation systems may be used within the scope this invention.

It should be understood that the term "yarn" is used only for the sake of clarity and that this invention specifically includes the capability for this machine to use yarns (twisted fiber bundles); threads (multiple yarns twisted together); and flexible multistrand fine wires, twisted or not. This machine cannot use monofiliments or stiff single strand wires.

This invention specifically includes the capability to utilize a variety of different fiber materials including a mix of different fibers in the same piece of the invention fabric. The different types of fiber material include but are not limited to organic material fibers such as wool, cotton, linen and others; inorganic fibers such as glass, carbon, asbestos and others; and flexible multistrand fine metal wires such as stainless steel, aluminum and others.

Method

Machine

This invention machine shall now be described.

Figure 1:
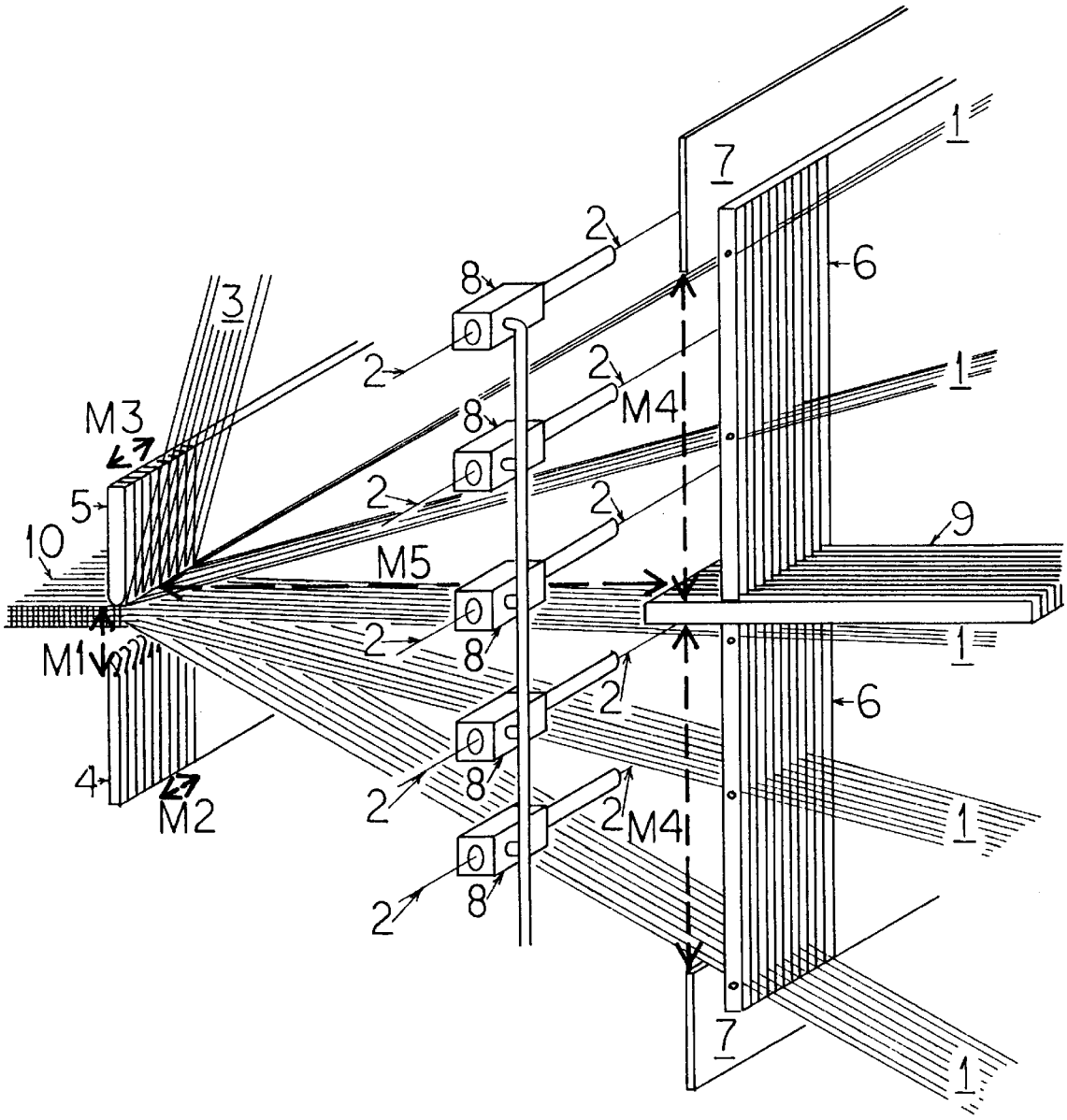
FIG. 1 is a general schematic arrangement of the principal components of the machine. Motions of the components are also shown. It is shown in cut-away and partially exploded perspective for clarity.

The first elements of the machine to be described are the X (warp) yarn guides 6, as shown in FIG. 1, which guide the multiple rows of X yarns 1. The X yarn guides feed the X yarns in multiple rows which are spaced far enough apart to provide adequate space for jets 8, to insert the Y (weft) yarns 2 between the rows of X yarns 1. The X yarn guides also accurately position the X yarns in the transverse direction at the exact spacing in the finished fabric. A variety of yarn guide designs are known to the art and any of them may be used in the practice of this invention provided they perform the described X yarn guide functions.

The next element described is the Y (weft) yarn insertion device. The Y (weft) yarns 2, as shown in FIG. 1, are inserted simultaneously across the width of the fabric through the open yarn corridors between the rows of X yarns 1. Although theoretically possible to insert Y yarns sequentially, this is undesirable because it requires more time, thus slowing output speed. The Y yarns are inserted using air or water jet nozzles 8 arranged in alignment with the openings between the rows of X yarns.

Air jet "feed" nozzles or "insertion" nozzles, operating alone, are capable of blowing a yarn about a half meter, depending on operating parameters. Water jet "feed" nozzles are capable of inserting yarns about one to two meters, depending on operating parameters. However, the water has significant mass and therefore follows a downward trajectory which requires that the sheds be opened very wide. If shed openings are restricted to practical widths required for three-dimensional fabric, then water jet yarn insertion is reduced to less than a meter. Very long insertion lengths are currently obtained through the use of "relay" nozzles, currently available with air jet systems but not water jet systems. In operation, several relay nozzles are spaced periodically between the sheds across the width of the fabric. A weft yarn is inserted by a feed nozzle and travels to the first relay nozzle. Each relay nozzle progressively blows the yarn across the shed to each next relay nozzle, all at very high speed. The physical arrangement of the relay nozzles must be modified to accommodate the yarn arrangement and element geometrics of a three-dimensional loom. However, current air jet systems known to the art and which include modified relay nozzles will permit maximum three-dimensional fabric widths in excess of 4 meters to be woven in the inventive machine.

A variety of air jet and water jet systems are known to the art, any of which may be used in the practice of this invention machine. Only the arrangement of the jet nozzles for simultaneous insertion of multiple Y (weft) yarns and the modification of air jet relay nozzel geometry for insertion of weft yarns in the weaving of three-dimensional fabric is new to the art.

Figure 2:
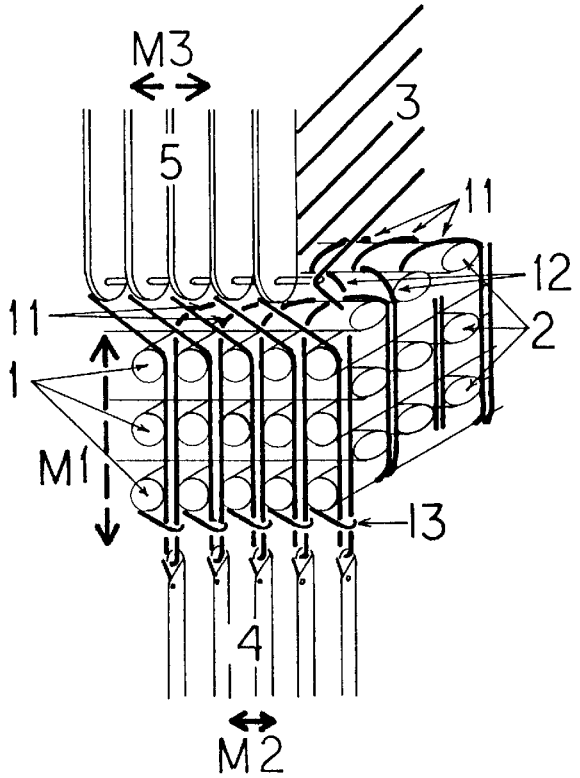
FIG. 2 is a detailed partial cross section of the machine and fabric at the needle bar. The view is from right toward left as shown in FIG. 1. Scale is magnified to clearly present detail of needle motions and the formation of the diagonal Z yarn loops at the top and bottom edges of the fabric. The pattern of fabric shown has equal numbers of rows of X and Y yarns.

The next element described is the knitting needle assembly 4 as shown in FIG. 1 and in FIG. 2. The assembly consists of a row of knitting needles arranged so they may be moved simultaneously up and down in a stroke motion, M1, as shown in FIGS. 1 and 2 and also so they may be moved simultaneously side to side in a shift motion, M2, also as shown in FIGS. 1 and 2. Before each vertical stroke, the needle assembly is shifted, M2, alternately to the right and then before the next stroke, to the left by a distance equal to one spacing of the X yarns. This carries the loops from the previous stroke 13, as shown in FIG. 2, below both a bottom most X and Y yarn . This creates a diagonal bottom loop in the fabric at alternating angles of +45° and −45° to the longitudinal.

Next, the needles stroke upward, M1, as shown in FIGS. 1 and 2, through the X yarns 1, catch Z yarns 3, and pull the Z yarns down through the X yarns and through the loops 13, of the previous stroke. This completes the knitting needle cycle and the process repeats after the yarns are beat.

A variety of different types of knitting needles are known to the art and several of them may be used in the practice of this invention if they perform the Z yarn insertion function described. What is new to the art is the use of conventional knitting needles, in conjunction with the other components described in this invention, to weave very wide three-dimensional fabrics at high speeds.

Figure 3A:
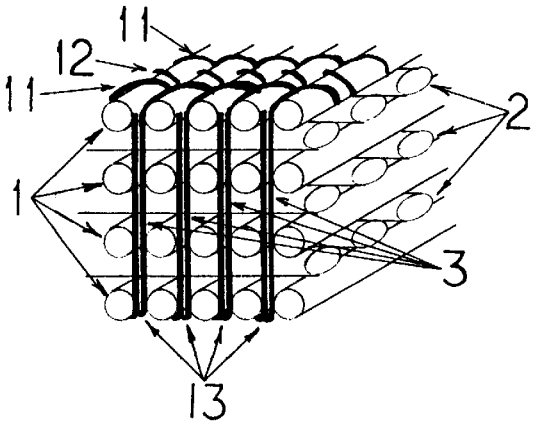
In FIG. 3A, the number of rows of X yarns is one more than the number of rows of Y yarns.
Figure 3B:
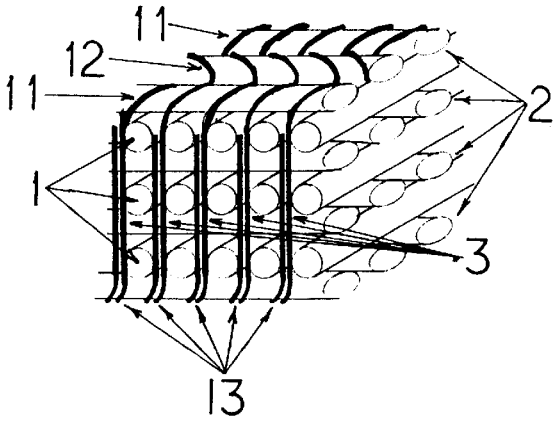
In FIG. 3B, the number of rows of Y yarns is one more than the number of rows of X yarns.

The next element described is the Z yarn guide 5, as shown in FIGS. 1 and 2 which positions each Z yarn 3 at the optimum location for each knitting needle 4 to catch the correct Z yarn at the top of the needle stroke M1. Before each stroke of the knitting needles, the Z yarn guide is shifted laterally, M3, as shown in FIGS. 1 and 2, alternately to the right and then, before the next stroke, to the left, by the distance required to position the Z yarns one needle spacing to the right or the left. This shift motion carries the Z yarns over both an X and Y yarn which creates diagonal loops at the top edge of the fabric at angles of +45° 11 and −45° 12 to the longitudinal direction as shown in FIGS. 2, 3A and 3B.

The alternate shifting of the Z yarn guide M3 in conjunction with the alternate shifting of the needle bar M2 also binds the right and left edge of the fabric. When the Z yarn guide and the needle bar shift left, the left most Z yarn passes outside all the left most X yarns. On the next stroke, the Z yarn guide and the needle bar shift right, the left most Z yarn now moves diagonally 45° to the right and is inserted between the left most and second left most X yarns. This binds the left most X yarns to the multiple rows of Y yarns. At the same time, the right most Z yarn passes outside all the right most X yarns. On the next stroke (and left shift) the right most X yarns will be bound in similar manner to the multiple rows of Y yarns.

A variety of yarn guide designs are known to the art, any of which may be used in the practice of this invention provided they perform the described Z yarn guide functions.

The next element described is the shed "closer" mechanism 7, as shown in FIG. 1. After the Y yarns 2, and the Z yarns 3, are inserted, the X yarn sheds are closed, M4, from the top and from the bottom by moving the rows of X yarns 1, (and the Y yarns previously inserted between the rows of X yarns) together to the longitudinal plane of the finished fabric 10, and also to the approximate thickness of the finished fabric. This action accurately positions all Y yarns relative to the beat reed, in preparation of the beat process. The closer holds the yarns in this position until the beat is done and then releases the rows of X yarns to return to their starting position, i.e. reopens the sheds. The shed closer device may be constructed of movable plates, sheets, wire or reeds all of which are possible and within the scope of the invention if they perform the described functions.

The next element described is the beat reed 9, as shown in FIG. 1. The beat reed consists of a multiplicity of reeds accurately spaced to fit between the vertical spaces within the longitudinal rows of X yarns. After the sheds are closed, the beat reed moves in the longitudinal direction, M5, engages the Y yarns, pushes them to the fell of the fabric, and compacts them into the completed fabric 10. The beat reed then retracts, M5, to its original position. A variety of beat reed designs are known to the art, some of which may be used in the practice of this invention provided they perform the described beat reed functions. It is also possible to combine the X yarn guide with the beat reeds into a single movable device which is also within the scope of the invention if it performs the described functions for the beat reed and the X yarn guide.

A variety of take-up devices are known to the art, any of which may be used in the practice of this invention to pull the completed fabric 10, from the machine. These include but are not limited to take-up rolls, a synchronized stepper motor driving a clamping puller and a variety of take-up drum designs.

A variety of actuation devices are known to the art, any of which may be used in the practice of this invention to actuate the components of the machine. These include but are not limited to pneumatic, hydraulic, electric or mechanical actuators and linkages or combination of these.

A variety of loom control devices are known to the art, any of which may be used in the practice of this invention which include but are not limited to manual, electric, electronic or computer control or a combination of these.

The maximum practical width of three-dimensional fabric that can be produced by this invention machine is related to the time required for jet insertion of the weft yarns. Wider fabric widths require longer insertion times which slow down the machine. However, practical widths of 4 meter or more can be achieved at loom speeds of several hundred cycles per minute using current art air jet systems.

This machine can produce three-dimensional fabric in continuous lengths. There are no known limitations on the length of the fabric that can be produced.

This machine can produce three-dimensional fabric in a variety of thicknesses. The maximum thickness that can be produced in current practice is limited to about 5 centimeters primarily by the shed opening required by existing jet systems for weft insertion. Known possible improvements to jet weft insertion systems may significantly increase the maximum thickness of fabric within the scope of this invention.

The maximum speed of this invention machine is limited by the speed of each of the components which, in turn, is influenced by the distances each component must travel. In this invention machine, the knitting needles travel only through the thickness of the fabric which is short and therefore very fast. The Z yarn guide motion is very short. The closer mechanism is designed so that each closer only closes half the warp yarn sheds, i.e. the upper closer only closes the upper half of the sheds and the lower closer only closes the lower half of the sheds. Thus, closer motion is kept as short as possible. The stroke of the beat reed has been kept as short as possible. In addition, several motions may be overlapped. As a result, practical speeds of several hundred cycles per minute can be achieved while producing three-dimensional fabric in practical widths, thicknesses and in continuous lengths.

Fabric Pattern

The fabric pattern produced by this invention method and machine is shown in FIGS. 2, 3A and 3B. It consists of multiple rows of longitudinal X (warp) yarns 1, aligned with the longitudinal axis; multiple rows of Y (weft) yarns 2, aligned with the transverse axis; and multiple rows of Z yarns 3, in the vertical axis. The rows of X, Y and Z yarns all serve to lock each other perfectly straight in the X, Y and Z planes of the Cartesian coordinate system orthogonal to each other at 90°. In this fabric pattern, the Z yarns form diagonal loops at the top 11,12 and bottom 13 edges of the fabric that cross respectively over, or under, both an X and Y yarn in angles that alternate at +45° 11 , or −45° 12,13, to the longitudinal axis as shown in FIGS. 2, 3A and 3B. These diagonal loops provide the capability to produce fabric in which the number of rows of X yarns equal the number of rows of Y yarns, as shown in FIG. 2; the number of rows of X yarns is one more than the number of Y yarns, as shown in FIG. 3A; or the number of rows of Y yarns is one more than the number of rows of X yarns, as shown in FIG. 3B. The alternating diagonal loops of Z yarns also bind the right most and left most X yarns to the fabric thus binding the right and left side edges of the fabric.

I claim:

1. A diagonal Z loop three-dimensional fabric pattern which consists of the following:

(a) multiple rows of X, warp, yarns aligned with the longitudinal axis of said fabric, (b) multiple rows of Y, weft, yarns aligned with the transverse axis of said fabric, (c) multiple rows of Z yarns aligned with the vertical axis or thickness of said fabric, (d) loops of the said Z yarns alternating at angles of +45° and −45° over the upper most said X and said Y yarns of said fabric, (e) loops of the said Z yarns alternating at angles of +45° and −45° under the bottom most said X and said Y yarns of said fabric, (f) and wherein the fabric uses the described alternating loops of said Z yarns to bind the right most and left most said X yarns and (g) the number of rows of said X yarns are equal to, one or more than, or one less than the number of rows of said Y yarns equal to, one or more than, or one less.

2. A machine to weave the claim 1 three-dimensional fabric in flat panels, wide widths and continuous lengths consisting of the following components:

(a) longitudinal X, warp, yarn guides for holding said rows of said X yarns of said fabric open far enough apart for insertion of said Y, weft, yarns, (b) modified air jet or water jet yarn insertion system for insertion of said Y, weft, yarns, (c) an assembly of knitting needles that insert said Z yarns and that form loops of said Z yarns at said alternating angles of +45° and −45° under the bottom most said X and said Y yarns, (d) a Z yarn guide that guides said Z yarns into said knitting needles and form loops of said Z yarns at said alternating angles of +45° and −45° over the upper most said X and said Y yarns, (e) a shed closer device that closes or brings together said rows of said X, warp, yarns after said Y, weft, yarns insertion, and (f) a beat reed that compacts said Y and Z yarns into said fabric.

* * * * *